US005707453A

United States Patent [19]

Shurman et al.

[11] Patent Number: 5,707,453

[45] Date of Patent: Jan. 13, 1998

[54] METHOD OF CLEANING INTERNAL CAVITIES OF AN AIRFOIL

[75] Inventors: Brian J. Shurman, Manchester; Peter J. Draghi, Simsbury, both of Conn.

[73] Assignee: United Technologies Corporation, Hartford, Conn.

[21] Appl. No.: 653,139

[22] Filed: May 24, 1996

Related U.S. Application Data

[63] Continuation of Ser. No. 343,291, Nov. 22, 1994, abandoned.

[51] Int. Cl.[6] ..... B08B 3/12

[52] U.S. Cl. ..... 134/1; 134/22.1

[58] Field of Search ..... 134/1, 22.1, 184

[56] References Cited

U.S. PATENT DOCUMENTS

| | | | |
|---|---|---|---|
| 2,468,550 | 4/1949 | Fruth | 8/159 |
| 2,616,820 | 11/1952 | Bargeaux | 148/6.15 |
| 2,702,260 | 2/1955 | Massa | 134/1 |
| 3,848,307 | 11/1974 | Kydd | 29/156.8 B |
| 3,862,851 | 1/1975 | Speirs et al. | 117/70 C |
| 4,290,391 | 9/1981 | Baldi | 122/511 |
| 4,439,241 | 3/1984 | Ault et al. | 134/22.17 |
| 4,608,128 | 8/1986 | Farmer et al. | 204/16 |
| 4,694,708 | 9/1987 | Keller et al. | 156/64 |
| 5,290,364 | 3/1994 | Stein et al. | 134/7 |
| 5,339,845 | 8/1994 | Huddas | 134/169 |
| 5,464,479 | 11/1995 | Kenton et al. | 134/1 |
| 5,490,882 | 2/1996 | Sachs et al. | 134/1 |
| 5,575,858 | 11/1996 | Chen et al. | 134/3 |

FOREIGN PATENT DOCUMENTS 0205355 12/1986 European Pat. Off. .

OTHER PUBLICATIONS

Industrial Chemical Cleaning; James W. McCoy, Chemical Publishing Company 1984, pp. 118, 153, 154, 155.

*Primary Examiner*—Robert J. Warden
*Assistant Examiner*—Saeed Chaudhyr
*Attorney, Agent, or Firm*—Marina F. Cunningham

[57] ABSTRACT

A cleaning method for gas turbine engine airfoils includes a step of immersing an ultrasonic agitator, such as a welding horn, into a tank with a cleaning solution and a step of directing the ultrasonic agitator onto the portion of the airfoil having the crust layer. A subsequent step of high pressure water jet spray removes the crust debris. The cleaning method of the present invention significantly increases the power density of the ultrasonic cleaning.

2 Claims, 2 Drawing Sheets

METHOD OF CLEANING INTERNAL CAVITIES OF AN AIRFOIL

This is a Continuation of application Ser. No. 08/343,291 filed Nov. 22, 1994, now abandoned.

TECHNICAL FIELD

This invention relates to gas turbine engines and, more particularly, to the cleaning of airfoils therefor during overhaul and repair.

BACKGROUND OF THE INVENTION

A typical gas turbine engine includes a compressor, a combustor, and a turbine. Both the compressor and the turbine include alternating rows of rotating and stationary airfoils. Air flows axially through the engine. As is well known in the art, the compressed gases emerging from the compressor are mixed with fuel in the combustor and burned therein. The hot products of combustion, emerging from the combustor at high pressure, enter the turbine where the hot gases produce thrust to propel the engine and to drive the turbine which in turn drives the compressor.

The gas turbine engine operates in an extremely harsh environment characterized by vibrations and very high temperatures. The airfoils in the turbine are in jeopardy of burning because of the hot gases emerging from the combustor. Various cooling schemes exist to provide adequate cooling to these turbine airfoils. Many of these cooling schemes include intricate internal passages, such as a serpentine passage, that vent cooling air therethrough. The cooling schemes also include tiny cooling holes formed within the wall structure of the airfoils to allow the cooling air to pass therethrough.

The air that circulates through the airfoils, particularly during operation on the ground, includes particles of sand, dust, and other contaminants that have been ingested by the engine. The sand and dust, aided by extremely high temperatures and pressures, adhere to the surface of the internal cavity of the airfoils forming a crust, which may reduce the size or entirely block the air holes and the internal passages within the airfoil, thereby reducing the efficiency of the cooling thereof. To ensure that internal cavities are passable for the cooling air, the airfoils must be cleaned periodically during their lifetime or replaced. Since the airfoils are manufactured from expensive materials to withstand high temperatures, vibrations and cycling, frequent replacement of all the airfoils would be very costly. Therefore, cleaning the airfoils is preferred. During the cleaning process even small amounts of crust deposits must be removed to avoid burning of that portion of the airfoil. Furthermore, each engine includes hundreds of airfoils. Any reduction in time to clean each airfoil can potentially result in tremendous time savings and subsequently lead to significant cost savings.

One known process for cleaning the internal cavities of the airfoils is an autoclave process. The autoclave process involves exposing the airfoils to high temperature and pressure fluid for a period of time. The process results in a loosening of the sand and dust layer. Following the autoclaving, a water blast at high pressure, directed at the internal cavity, removes the loosened layer of the sand and dust. Each airfoil may have to undergo multiple autoclave cycles to be effectively cleaned. Each cycle is time consuming and costly. Moreover, the autoclave process is effective in removing the crust only when the build-up is fine or the internal passage is not complicated. However, the method is not effective when the dust layer is thick or the passage is complicated.

Another known process for cleaning airfoils is ultrasonic cleaning. During the ultrasonic cleaning a batch of airfoils is submerged into a tank filled with a mild alkali solution and ultrasonically agitated to loosen a crust layer deposited within internal cavities. A subsequent water jet blast removes the crust debris from the internal cavities. A typical transducer used to provide ultrasonic agitation yields power densities of 1–10 watts per square inch. The highest power ultrasonic cleaners commercially available have power densities of 100 watts per square inch. This greater ultrasonic power is achieved by positioning multiple transducers in a predetermined pattern within the tank with the cleaning solution. Although the ultrasonic cleaning provides a good general cleaning for airfoils, it is ineffective for some portions of airfoils with intricate internal passages and tougher crust deposits. For better results the ultrasonic cleaning is often used in multiple cycles with high pressure water blast following each cycle. However, even multiple cycling is not sufficient to loosen some tougher crust accumulations. The airfoils are typically inspected for remaining dirt blockage after each cleaning cycle by being X-rayed. If X-ray shows even a small portion of the airfoil having crust deposit remaining therein, the entire airfoil undergoes another cycle of ultrasonic cleaning. Frequently, even additional cycles do not remove all crust deposits. An airfoil must be discarded even if only a minute amount of crust deposit remains within the internal passages.

The current technology of ultrasonic agitation has not evolved to provide higher power density cleaning and thus becomes a limiting factor in the cleaning of airfoils. Power densities are limited by the physical characteristics of the transducers. The transducers tend to overheat and degrade when overdriven. Also, if too many ultrasonic transducers are introduced into the tank with the cleaning solution, ultrasonic waves cancel each other out, thereby reducing the effectiveness of the ultrasonic cleaning. Additionally, multiple cycling is time consuming and costly. Furthermore, only a small portion of some airfoils requires additional cleaning rather than the entire airfoil. Thus, cleaning the entire airfoil becomes wasteful.

The aerospace industry, in general, and overhaul and repair facilities for the aerospace industry, in particular, are at loss as to how to effectively clean airfoils with intricate internal cooling passages. There is a potential for a great deal of cost savings on replacement airfoils if the cleaning process for the old airfoils is improved. As the airfoil structure has become very sophisticated, the entire industry is searching for an improved method of cleaning the airfoils.

DISCLOSURE OF THE INVENTION

According to the present invention, a method for cleaning internal cavities of an airfoil of a gas turbine engine includes a step of immersing the airfoil in a cleaning solution and a step of focusing the intensified ultrasonic energy onto a portion of the airfoil having a crust layer by pointing an ultrasonic agitator submerged in the solution onto the portion of the airfoil having a crust layer. By focusing the ultrasonic energy on a specific portion of the airfoil, the level of ultrasonic agitation is intensified and concentrated on that specific effected area. The cleaning method of the present invention provides an increase of 400% over the prior art in power density applied to the portion of the airfoil with dirt blockage.

This method is particularly useful to remove dirt deposits from airfoils that have been previously subjected to general cleaning after which a specific area of the airfoil with remaining dirt deposits has been identified through an X-ray. By focusing on the specific portion of the airfoil allows only that specific portion to be cleaned, rather than subjecting the entire airfoil to the unnecessary cleaning process. This method provides an effective cleaning at a significant cost and time savings.

One advantage of the present invention is that this cleaning method is environmentally safe.

The foregoing and other advantages of the present invention become more apparent in light of the following detailed description of the exemplary embodiments thereof, as illustrated in the accompanying drawings.

BEST MODE FOR CARRYING OUT THE INVENTION

Figure 1:
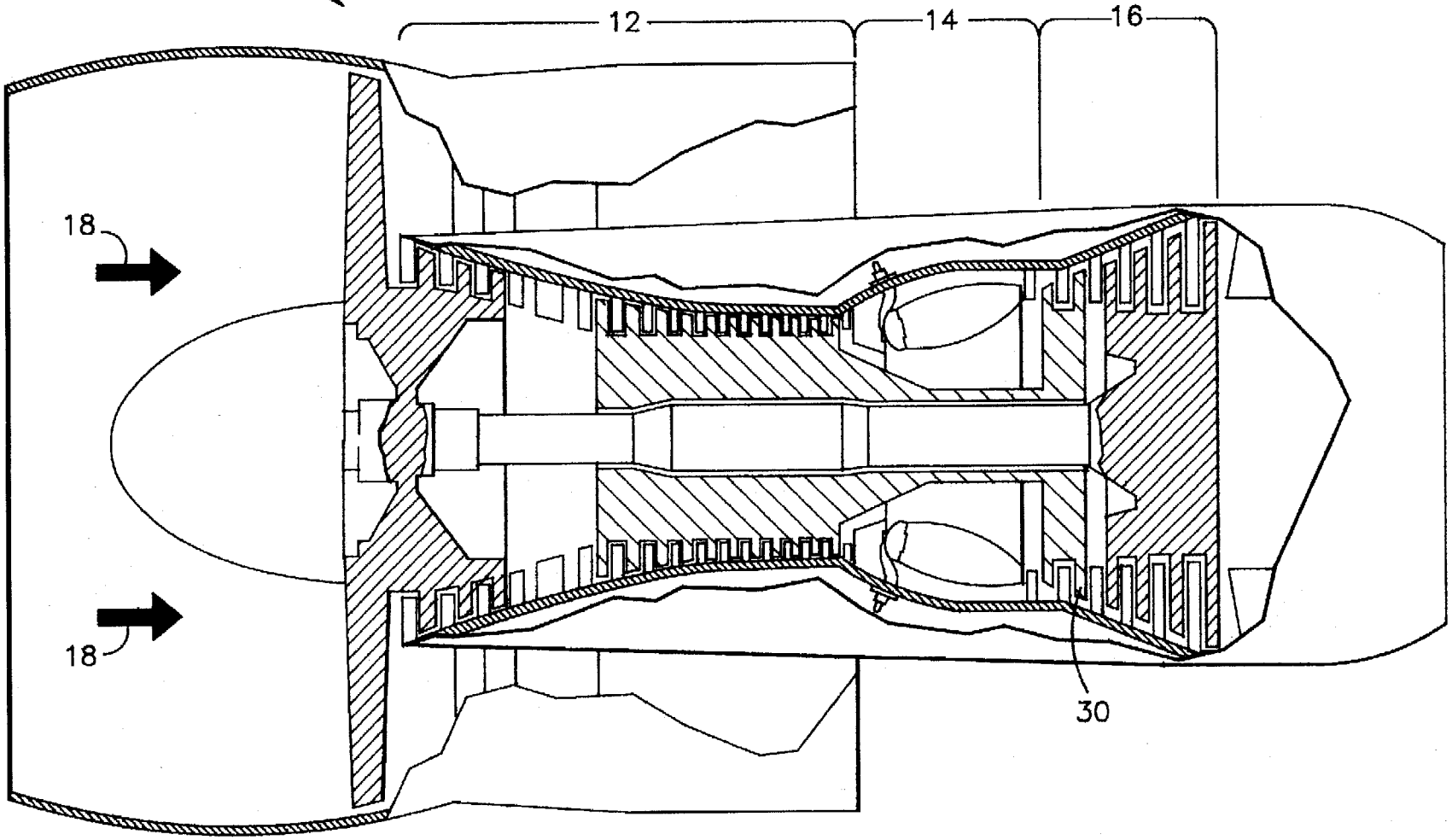
FIG. 1 is a schematic, partially sectioned elevation of a gas turbine engine.

Referring to FIG. 1, a gas turbine engine 10 includes a compressor 12, a combustor 14, and a turbine 16. Air 18 flows axially through the engine 10. As is well known in the art, air 18 is compressed in the compressor 12. Subsequently, the compressor air is mixed with fuel and burned in the combustor 14. The hot products of combustion enter the turbine 16 wherein the hot gases expand to produce thrust to propel the engine 10 and to drive the turbine 16, which in turn drives the compressor 12.

Figure 2:
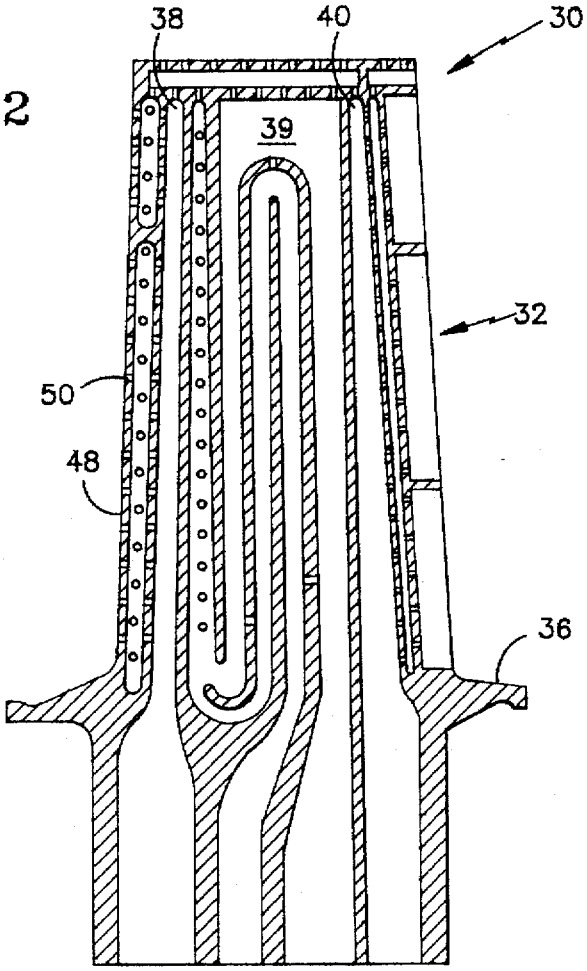
FIG. 2 is an enlarged, sectional elevation of an airfoil.
Figure 3:
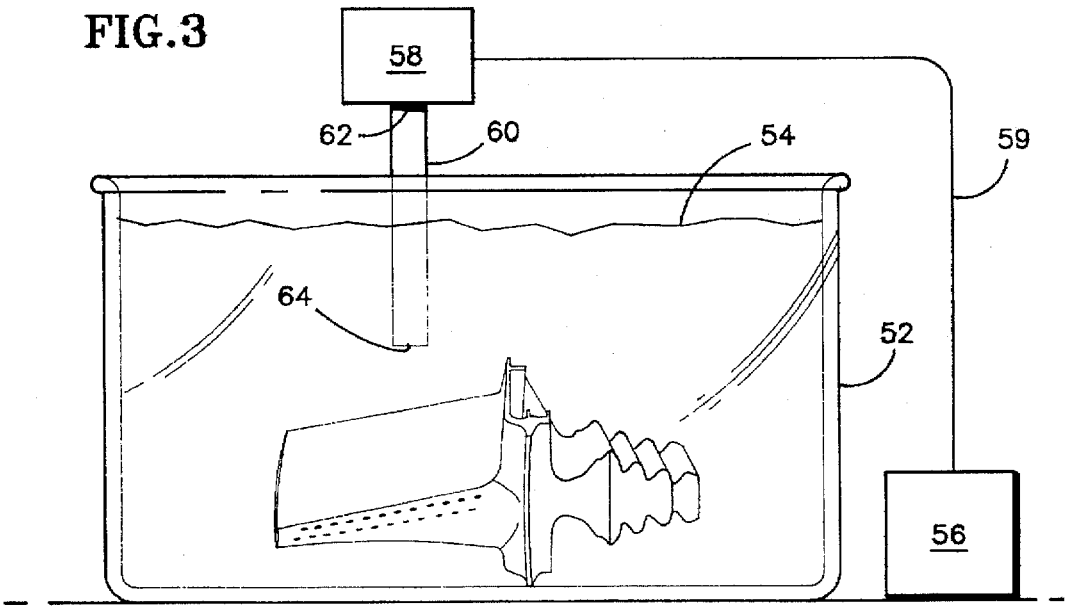
FIG. 3 is a schematic representation of a system for cleaning of airfoils according to the present invention.

Both the compressor 12 and the turbine 16 include alternating rows of rotating and stationary airfoils 30. Each airfoil 30, as shown in FIG. 2, includes an airfoil portion 32 and an inner diameter platform 36. The turbine airfoils 30 include elaborate internal passages 38–40 that channel cool air therethrough to cool airfoil walls 48. The airfoil walls 48 include a plurality of film holes 50 that allow cool internal air to exit the internal passages 38–40 of the airfoil 30. As cooling air passes through the internal cooling passages 38–40 at high temperature and pressure, dust and sand particles that are ingested by the engine 10 adhere to the internal walls 48 of the passages 38–40. The dust and sand particles form a layer of crust that reduces the size of the internal passages 38–40 and can block the film holes 50. The complete or even partial blockage of the passages 38–40 and the film holes 50 causes inefficiency in engine performance and can result in burning of the airfoil walls. The airfoils are periodically removed from the engine for cleaning purposes.

The airfoil 30 first undergoes a general cleaning by any conventional method. The airfoil is subsequently X-rayed to determine what portions of the airfoil still have dirt blockage therein. Once at least one portion of the airfoil is identified as having dirt blockage, the airfoil 30 is immersed in a tank 52 filled with a cleaning solution 54. The airfoil 30 is maneuvered in the tank 52 to ensure that the solution 54 fills the internal passages 38–40 of the airfoil 30. A power source 56 supplies electrical power to a transducer 58 by means of a power cable 59. The transducer 58 converts electrical energy supplied by the power source 56 into mechanical energy.

A welding horn 60 includes a first end 62 and a second end 64. The first end 62 of the horn 60 attaches onto the transducer 58. The second end 64 of the horn 60 is immersed into the tank 52 with the solution 54 and positioned above the portion of the airfoil 30 that includes crust deposit. The effected portion of the airfoil 30 is ultrasonically agitated for approximately one half of an hour by ultrasonic waves generated by the welding horn 60. The airfoil 30 is subsequently rinsed with a high power water blast to remove the crust debris from the internal passages. The airfoil can be X-rayed to determine if all of the crust deposit was removed. If the X-ray shows that some portion of the airfoil still includes a crust layer, that portion of the airfoil can be subjected to additional agitation by the horn 60.

The cleaning process of the present invention focuses the ultrasonic energy on a specific portion of the airfoil that includes a layer of crust and requires additional cleaning of that specific portion of the airfoil. By focusing on a specific portion of the airfoil, this cleaning method increases power density of ultrasonic energy directed onto the portion of the airfoil that requires cleaning. The increased power density of the ultrasonic energy is more effective in loosening the hardened crust layer from the effected portion of the airfoil. The welding horn yields power densities of up to 400 watts per square inch, thereby providing a 400% improvement over the prior art. The cleaning method of the present invention enables cleaning of airfoils that had to be previously discarded. The cleaning method of the present invention also increases efficiency, since only the portions of the airfoils that need cleaning are cleaned rather than the entire airfoil. The welding horn is also significantly less expensive than the conventional ultrasonic cleaning processes.

Additionally, the cleaning method of the present invention represents significant savings in time that translates directly into additional cost savings. The importance of such savings can be underscored by the fact that each gas turbine engine includes hundreds of airfoils. Reducing the time for cleaning each airfoil also means that the time for cleaning all airfoils in the engine is reduced. Furthermore, the cleaning method of the present invention is environmentally safe.

The cleaning solution 54 can be any type of a wetting agent solution or a mild alkali solution. The welding horn 60 can be any type of an ultrasonic agitator having varying mass, shape or density, as long as the optimal frequency for cleaning applications of approximately 20,000 hertz is achieved.

Although the invention has been shown and described with respect to exemplary embodiments thereof, it should be understood by those skilled in the art that various changes, omissions, and additions may be made thereto, without departing from the spirit and scope of the invention.

We claim:

1. A method for cleaning internal cavities of an airfoil of a gas turbine engine, said airfoil having internal cavities, a portion of said airfoil having a crust layer in an internal cavity thereof, comprising:

immersing said airfoil in a liquid cleaning solution in a manner such that said liquid cleaning solution fills said internal cavities;

immersing an ultrasonic agitator into said cleaning solution, wherein said ultrasonic agitator is a welding horn;

positioning said ultrasonic agitator adjacent said airfoil; and focusing intensified ultrasonic energy on said portion of said airfoil having a crust layer thereon.

2. A method for cleaning internal cavities of an airfoil of a gas turbine engine, said airfoil having internal cavities, said airfoil having a crust layer in an internal cavity thereof, comprising:

performing a general cleaning of said airfoil by any conventional method;

identifying any portion of said airfoil having a remaining crust layer;

immersing said airfoil in a liquid cleaning solution so that said liquid cleaning solution fills said internal cavities;

immersing an ultrasonic agitator into said cleaning solution, wherein said ultrasonic agitator is welding horn;

positioning said ultrasonic agitator adjacent said airfoil;

focusing intensified ultrasonic energy on said identified portion of said airfoil having a crust layer thereon.

* * * * *